US008827755B2

(12) United States Patent
Blakborn

(10) Patent No.: US 8,827,755 B2
(45) Date of Patent: Sep. 9, 2014

(54) HIGH CURRENT CONNECTOR

(75) Inventor: Willem Blakborn, Inzell (DE)

(73) Assignee: Rosenberger Hochfrequenztechnik GmbH & Co, KG, Fridolfing (DE)

( * ) Notice: Subject to any disclaimer, the term of this patent is extended or adjusted under 35 U.S.C. 154(b) by 16 days.

(21) Appl. No.: 13/579,077

(22) PCT Filed: Mar. 16, 2011

(86) PCT No.: PCT/EP2011/001310

§ 371 (c)(1),
(2), (4) Date: Aug. 15, 2012

(87) PCT Pub. No.: WO2011/113594

PCT Pub. Date: Sep. 22, 2011

(65) Prior Publication Data

US 2012/0315802 A1 Dec. 13, 2012

(30) Foreign Application Priority Data

Mar. 16, 2010 (DE) ..... 20 2010 003 649 U

(51) Int. Cl.
*H01R 13/187* (2006.01)
*H01R 13/11* (2006.01)
*H01R 13/53* (2006.01)

(52) U.S. Cl.
CPC ..... *H01R 13/53* (2013.01); *H01R 13/113* (2013.01); *H01R 13/187* (2013.01)
USPC ..... 439/845

(58) Field of Classification Search
USPC ..... 439/843–847
See application file for complete search history.

(56) References Cited

U.S. PATENT DOCUMENTS

| | | | | | |
|---|---|---|---|---|---|
| 3,086,190 | A | * | 4/1963 | Neidecker et al. | 439/638 |
| 3,470,527 | A | * | 9/1969 | Francois | 439/843 |
| 3,845,451 | A | * | 10/1974 | Neidecker | 439/295 |
| 4,083,622 | A | * | 4/1978 | Neidecker | 439/86 |
| 4,128,293 | A | * | 12/1978 | Paoli | 439/843 |
| 4,662,706 | A | * | 5/1987 | Foley | 439/851 |
| 4,720,157 | A | * | 1/1988 | Nestor et al. | 439/851 |
| 4,749,357 | A | * | 6/1988 | Foley | 439/80 |
| 4,753,616 | A | * | 6/1988 | Molitor | 439/787 |

(Continued)

FOREIGN PATENT DOCUMENTS

| | | | |
|---|---|---|---|
| DE | 29915380 | U1 | 1/2001 |
| DE | 10324492 | B3 | 12/2004 |
| EP | 1107378 | A1 | 6/2001 |
| JP | 8078081 | A | 3/1996 |

*Primary Examiner* — Ross Gushi
(74) *Attorney, Agent, or Firm* — DeLio, Peterson & Curcio, LLC; Robert Curcio

(57) ABSTRACT

A high current connector for transmitting electrical currents with at least one contact element establishing an electric contact between an internal current guiding element and an external current guiding element, having a plurality of spring elements establishing an electric multipoint contact between the internal current guiding element and the external current guiding element. The contact element arranged in a housing together with the external guiding element so that said spring elements establish an electric contact with the external current guiding element on the radial outer side of the contact element and an internal guiding element can be inserted into the housing so that the spring elements establish a contact with the internal current guiding element on a radial inner side of the contact element. The housing overlaps the external current guiding element in the axial direction, having a radially inwardly rising housing section.

5 Claims, 4 Drawing Sheets

(56) References Cited

U.S. PATENT DOCUMENTS

| | | | | | |
|---|---|---|---|---|---|
| 4,934,965 | A * | 6/1990 | Buddrus et al. | 439/845 |
| 5,088,942 | A * | 2/1992 | Welsh et al. | 439/843 |
| 5,147,229 | A * | 9/1992 | Nestor | 439/843 |
| 5,203,813 | A * | 4/1993 | Fitzsimmons et al. | 29/876 |
| 5,421,751 | A * | 6/1995 | Bennett et al. | 439/843 |
| 5,431,576 | A * | 7/1995 | Matthews | 439/247 |
| 5,433,630 | A * | 7/1995 | Inaba et al. | 439/843 |
| 5,445,533 | A * | 8/1995 | Roscizewski et al. | 439/184 |
| 5,474,479 | A * | 12/1995 | Bennett et al. | 439/843 |
| 5,525,069 | A * | 6/1996 | Roscizewski et al. | 439/184 |
| 5,588,884 | A * | 12/1996 | Rudoy et al. | 439/845 |
| 5,591,039 | A * | 1/1997 | Matthews | 439/181 |
| 5,667,413 | A * | 9/1997 | Trafton | 439/843 |
| 5,676,571 | A * | 10/1997 | Matthews | 439/843 |
| 5,681,187 | A * | 10/1997 | Fukushima et al. | 439/700 |
| 5,911,605 | A * | 6/1999 | Wooldridge et al. | 439/790 |
| 6,042,432 | A * | 3/2000 | Hashizawa et al. | 439/843 |
| 6,062,919 | A * | 5/2000 | Trafton | 439/843 |
| 6,089,929 | A * | 7/2000 | Sloey | 439/845 |
| 6,102,746 | A * | 8/2000 | Nania et al. | 439/675 |
| 6,210,240 | B1 * | 4/2001 | Comerci et al. | 439/853 |
| 6,254,439 | B1 * | 7/2001 | Endo et al. | 439/843 |
| 6,264,508 | B1 * | 7/2001 | Lehmann | 439/843 |
| 6,273,766 | B1 * | 8/2001 | Zennamo et al. | 439/843 |
| 6,276,960 | B1 * | 8/2001 | Schaefer et al. | 439/522 |
| 6,287,156 | B1 * | 9/2001 | Swan et al. | 439/845 |
| 6,416,340 | B2 * | 7/2002 | Schaefer et al. | 439/224 |
| 6,425,786 | B1 * | 7/2002 | Scholler | 439/843 |
| 6,485,337 | B2 * | 11/2002 | Hsieh | 439/845 |
| 6,520,998 | B1 * | 2/2003 | Scholler et al. | 439/851 |
| 6,656,002 | B2 * | 12/2003 | Zhao et al. | 439/851 |
| 6,672,911 | B2 * | 1/2004 | Zhao et al. | 439/845 |
| 6,692,316 | B2 * | 2/2004 | Hsieh et al. | 439/845 |
| 6,752,668 | B2 * | 6/2004 | Koch, Jr. | 439/843 |
| 6,783,406 | B2 * | 8/2004 | Keiser et al. | 439/827 |
| 6,837,756 | B2 * | 1/2005 | Swearingen et al. | 439/843 |
| 6,848,922 | B2 * | 2/2005 | Coughlan et al. | 439/181 |
| 6,899,571 | B1 * | 5/2005 | Koch et al. | 439/843 |
| 6,923,661 | B1 * | 8/2005 | Bogiel et al. | 439/78 |
| 6,926,547 | B2 * | 8/2005 | Schoepf et al. | 439/185 |
| 6,966,802 | B2 * | 11/2005 | Hielscher et al. | 439/841 |
| 7,011,548 | B2 * | 3/2006 | Bogiel et al. | 439/630 |
| 7,014,516 | B2 * | 3/2006 | Yang | 439/845 |
| 7,048,586 | B2 * | 5/2006 | Ishizaki et al. | 439/607.44 |
| 7,048,596 | B2 * | 5/2006 | Swearingen et al. | 439/843 |
| 7,150,660 | B2 * | 12/2006 | Allgood et al. | 439/845 |
| 7,241,189 | B2 * | 7/2007 | Mohs et al. | 439/845 |
| 7,311,566 | B2 * | 12/2007 | Dent | 439/843 |
| 7,387,548 | B2 * | 6/2008 | Takehara et al. | 439/843 |
| 7,601,019 | B2 * | 10/2009 | Hsieh et al. | 439/345 |
| 7,744,376 | B2 * | 6/2010 | Vrenna et al. | 439/60 |
| 7,775,841 | B2 * | 8/2010 | Coe et al. | 439/843 |
| 7,789,720 | B2 * | 9/2010 | Zinn | 439/845 |
| 7,805,838 | B2 * | 10/2010 | Morana et al. | 29/868 |
| 7,837,519 | B2 * | 11/2010 | Copper et al. | 439/839 |
| 7,845,993 | B2 * | 12/2010 | Falchetti | 439/843 |
| 7,857,671 | B2 * | 12/2010 | Carboni et al. | 439/824 |
| 7,942,682 | B2 * | 5/2011 | Copper et al. | 439/185 |
| 7,942,683 | B2 * | 5/2011 | Copper et al. | 439/187 |
| 8,038,488 | B2 * | 10/2011 | Mukuno | 439/845 |
| 8,057,269 | B2 * | 11/2011 | Ledermann et al. | 439/827 |
| 8,128,441 | B2 * | 3/2012 | Mukuno | 439/845 |
| 8,142,238 | B2 * | 3/2012 | Heigl et al. | 439/843 |
| 8,257,102 | B2 * | 9/2012 | Delgado et al. | 439/247 |
| 8,388,389 | B2 * | 3/2013 | Costello et al. | 439/839 |
| 8,419,486 | B2 * | 4/2013 | Tyler | 439/842 |
| 8,430,698 | B2 * | 4/2013 | Stewart et al. | 439/843 |
| 2001/0019923 | A1 * | 9/2001 | Moll et al. | 439/816 |
| 2002/0025732 | A1 * | 2/2002 | Hsieh | 439/845 |
| 2002/0049006 | A1 * | 4/2002 | Zhao et al. | 439/843 |
| 2002/0187686 | A1 * | 12/2002 | Zhao et al. | 439/843 |
| 2003/0060090 | A1 * | 3/2003 | Allgood et al. | 439/845 |
| 2003/0068931 | A1 * | 4/2003 | Swearingen et al. | 439/843 |
| 2003/0077950 | A1 * | 4/2003 | Swearingen et al. | 439/843 |
| 2003/0194919 | A1 * | 10/2003 | Hsieh et al. | 439/845 |
| 2004/0033732 | A1 * | 2/2004 | Koch, Jr. | 439/843 |
| 2006/0014442 | A1 * | 1/2006 | Allgood et al. | 439/843 |
| 2006/0063438 | A1 * | 3/2006 | Dent | 439/843 |
| 2007/0066152 | A1 * | 3/2007 | Mohs et al. | 439/843 |
| 2009/0029605 | A1 * | 1/2009 | Matsumoto et al. | 439/843 |
| 2009/0036003 | A1 * | 2/2009 | Morana et al. | 439/843 |
| 2010/0003866 | A1 * | 1/2010 | Dent et al. | 439/843 |
| 2010/0191299 | A1 * | 7/2010 | Ayzenberg | 607/2 |
| 2010/0216337 | A1 * | 8/2010 | Copper et al. | 439/571 |
| 2010/0216354 | A1 * | 8/2010 | Copper et al. | 439/805 |
| 2011/0045712 | A1 * | 2/2011 | Mukuno | 439/845 |
| 2012/0315802 | A1 * | 12/2012 | Blakborn | 439/700 |

* cited by examiner

HIGH CURRENT CONNECTOR

This application is a National Stage filing based on PCT/EP2011/001310, filed Mar. 16, 2011, and which claims priority to German Patent Application No. DE 20 2010 003 649.6, filed Mar. 16, 2010.

BACKGROUND OF THE INVENTION

1. Field of the Invention

The invention relates to a high current connector for transmitting electric currents, comprising at least one contact element for establishing an electrical contact between an internal current conducting element and an external current conducting element, the contact element comprising a plurality of spring elements for establishing an electrical multi-point contact between the internal current conducting element and the external current conducting element, the contact element being arranged in a housing together with the external current conducting element in such a manner that the spring elements establish an electrical contact with the external current conducting element at a radial outer side of the contact element and that an internal current conducting element can be inserted into the housing at a plug-side end of the high current connector in such a manner that the spring elements establish an electrical contact with the internal current conducting element at a radial inner side of the contact element.

2. Description of Related Art

DE 103 24 492 B3 discloses a connecting arrangement which is capable of carrying high currents and an associated contact element, the contact element having a plurality of spring elements for multi-point contact between an internal current conducting element and an external current conducting element. The spring elements are arranged in a sleeve-shaped basic structure between an upper and a lower annular support element, such that, on insertion of the internal current conducting element into the external current conducting element, the spring elements become torsionally rotated.

SUMMARY OF THE INVENTION

Bearing in mind the problems and deficiencies of the prior art, it is therefore an object of the present invention to broaden the field of application and improve the manufacturing and assembly of a high current connector of the aforementioned type.

This aim is achieved with a high current connector of the aforementioned type. Advantageous embodiments of the invention are described in the claims.

The above and other objects, which will be apparent to those skilled in the art, are achieved in the present invention which is directed to a high current connector for transmitting electric currents, comprising at least one contact element establishing an electrical contact between an internal current conducting element and an external current conducting element, the contact element having a plurality of spring elements establishing an electrical multi-point contact between the internal current conducting element and the external current conducting element, the contact element arranged in a housing together with the external current conducting element such that the spring elements establish an electrical contact with the external current conducting element at a radial outer side of the contact element, and that an internal current conducting element can be inserted into the housing at a plug-side end of the high current connector in such a manner that the spring elements establish contact with the internal current conducting element at a radial inner side of the contact element, the housing extending, at the plug-side end of the high current connector, beyond the external current conducting element in the axial direction, over a predetermined section and, the housing including, in the region of the predetermined section, a radially inwardly projecting housing section such that the contact element is fixed by resting against the projecting housing section in the axial direction inside the housing.

The contact element may be rectangular in cross-section. The contact element may further include, at each axial end thereof, a rectangular support frame, the spring elements being mechanically and electrically connected at each axial end thereof to the support frame.

The spring elements may be lamellar and tilted relative to the support frames.

The high current connector may include at least one lug arranged at one axial end of at least one of the support frames facing away from the spring elements.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
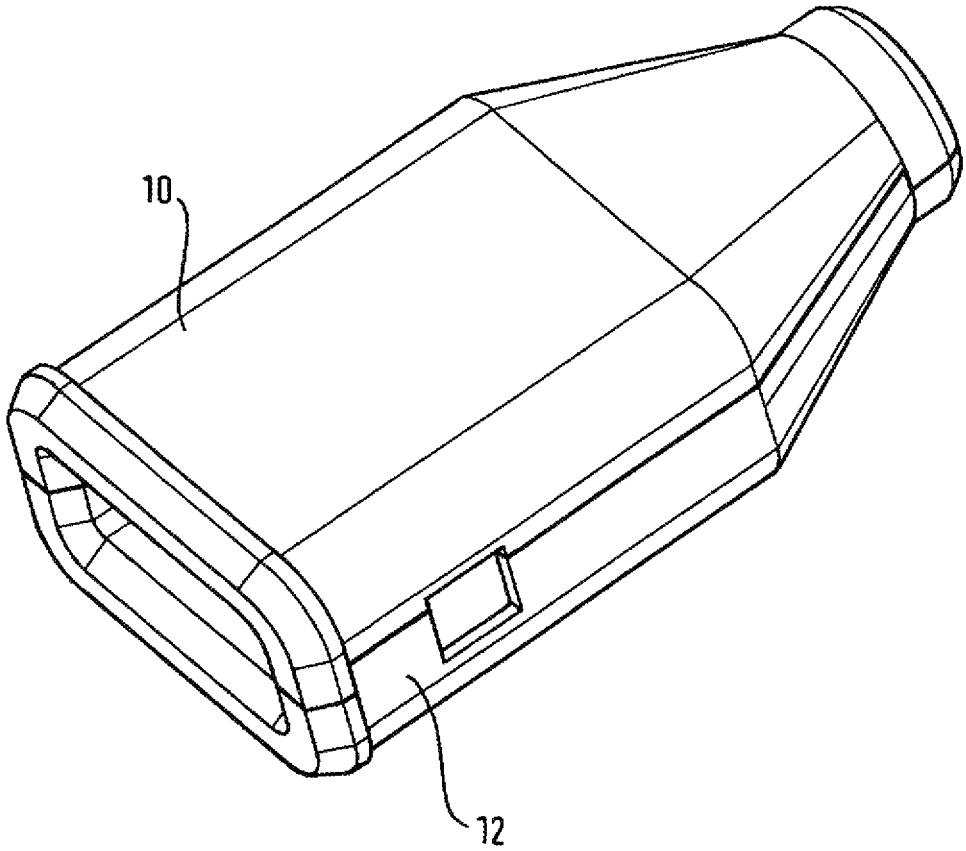
FIG. 1 shows a preferred embodiment of a high current connector according to the invention in a perspective view.
Figure 2:
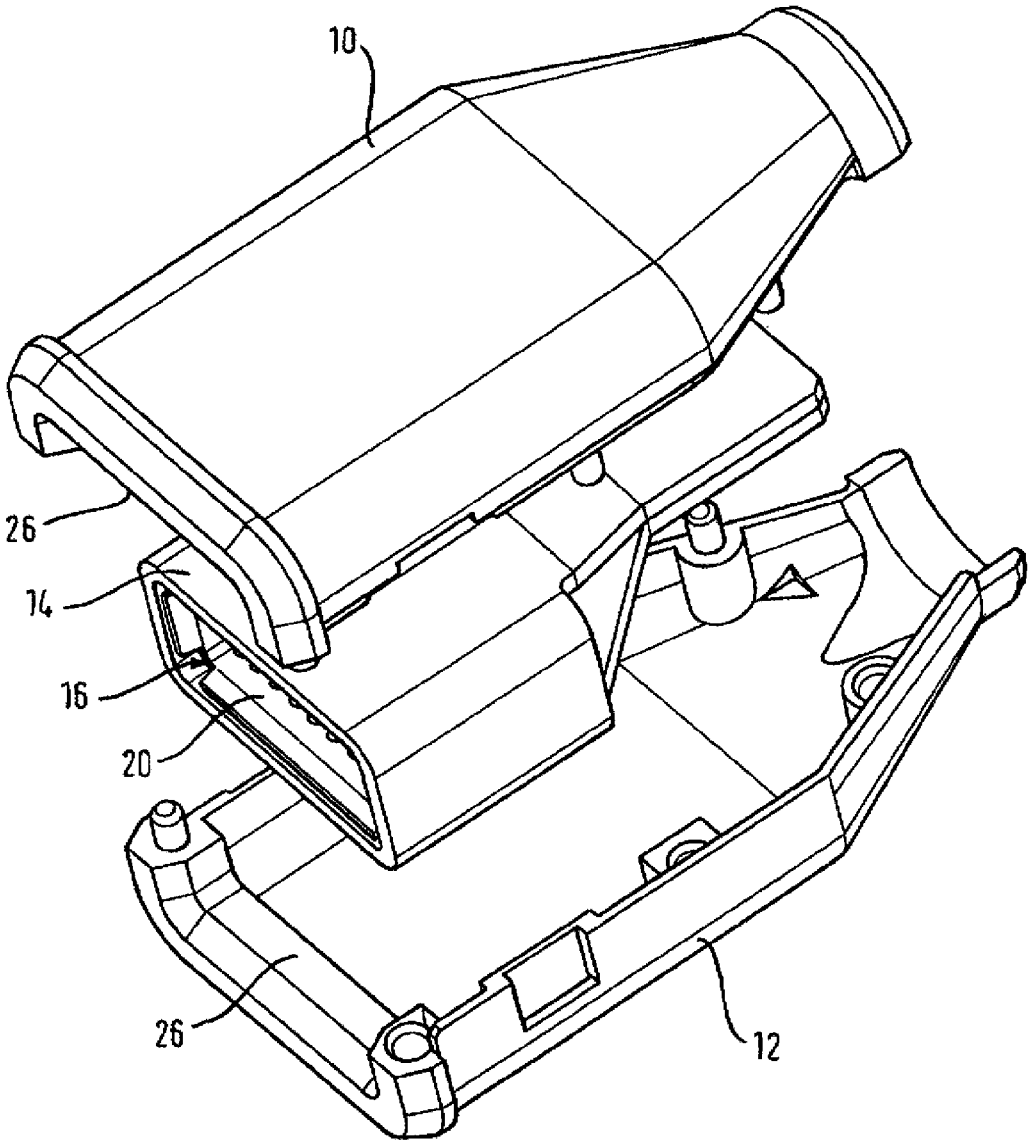
FIG. 2 shows the high current connector according to FIG. 1 in an exploded view.
Figure 3:
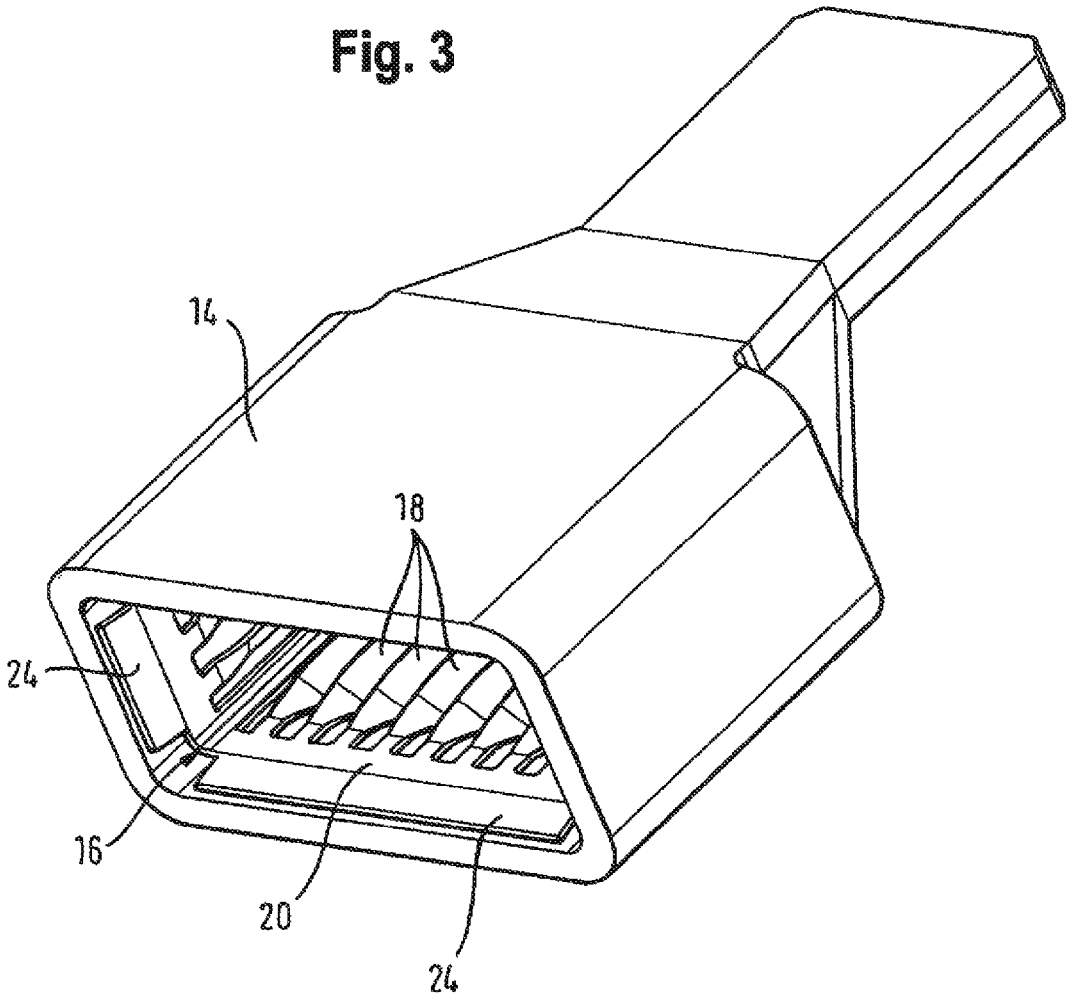
FIG. 3 shows an external current conducting element with a contact element of the high current connector of FIG. 1 in a perspective view.
Figure 4:
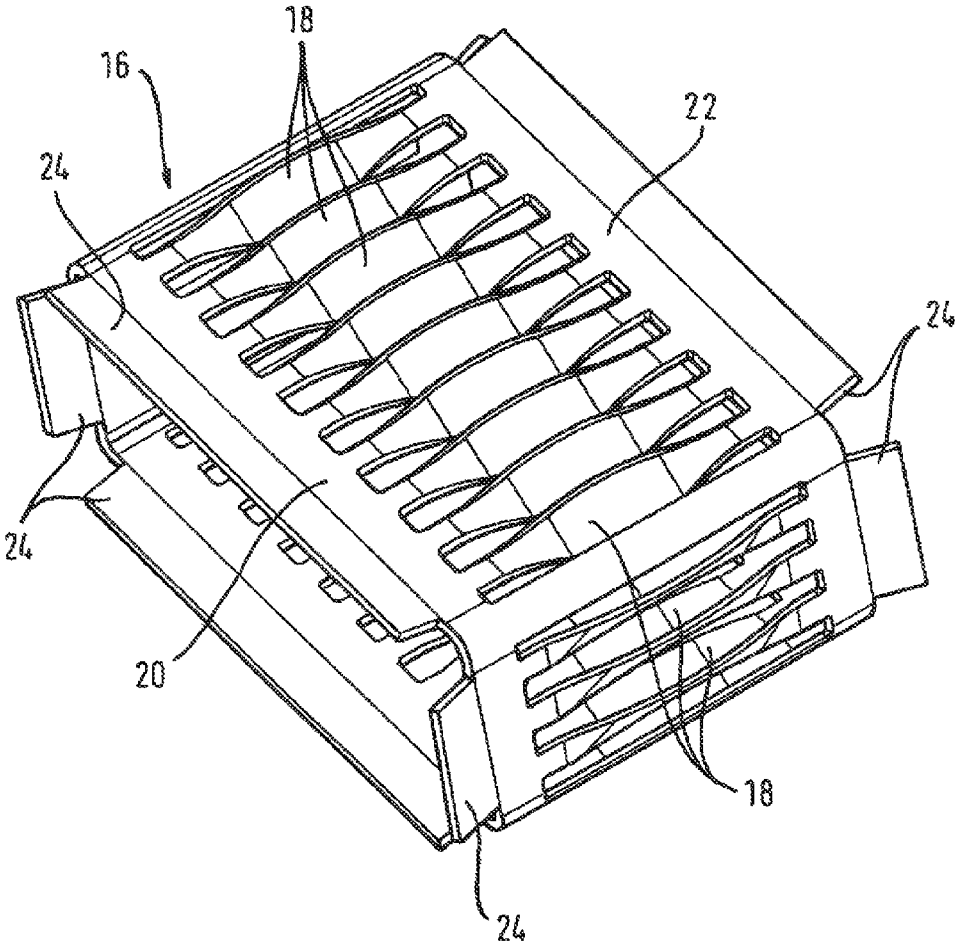
FIG. 4 shows the contact element of the high current connector of FIG. 1 in a perspective view.

In describing the preferred embodiment of the present invention, reference will be made herein to FIGS. 1-4 of the drawings in which like numerals refer to like features of the invention.

In a high current connector of the aforementioned type, it is provided according to the invention that the housing extends, at the plug-side end of the high current connector, beyond the external current conducting element in the axial direction over a predetermined section and comprises, in the region of the predetermined section, a radially inwardly projecting housing section in such a manner that the contact element is fixed by resting against the projecting housing section in the, axial direction inside the housing.

This has the advantage that, for axial fixing of the contact element within the high current connector, no additional undercut is required at the external current conducting element, but that the axial fixing is automatically created on assembly of the housing. This reduces the production costs and the effort involved in assembling the high current connector.

A configuration of the high current connector which is particularly twist-resistant, having a large number of contact points to the internal and external current conducting elements, is achieved in that the contact element is configured rectangular in cross-section. The high current connector can also be easily integrated into rectangular connector housings. In addition, an economical high current connector for rectangular internal and external current conducting elements is available, wherein surprisingly, high electric currents can simultaneously be conducted. As a result of the rectangular configuration of the contact element, economical and time-saving production methods can be used for the high current conductor.

A particularly mechanically stable high current connector is achieved in that the contact element has, at each axial end thereof, a rectangular support frame, wherein the spring elements are mechanically and electrically connected at each axial end thereof to a support frame.

A particularly strong torsional twisting of the spring elements with a particularly high contact force on plugging together the internal and external current conducting elements is achieved in that the spring elements are configured lamellar and are tilted relative to the support frames.

Simple and mechanically reliable fixing is achieved in that at least one lug is arranged at one axial end of at least one support frame facing away from the spring elements. The lug makes contact with the radially inwardly projecting housing section.

The preferred embodiment of a high current connector shown in FIGS. 1 to 4 comprises a housing having a housing upper part 10 and a housing lower part 12, as well as an external current conducting element 14 and a contact element 16. The contact element 16 is configured as a sprung lamellar cage with sprung lamellae 18 as spring contact elements, the contact element 16 comprising a first support frame 20 and a second support frame 22, between which the sprung lamellae 18 are arranged.

The opposing sides of the sprung lamellae 18 are each electrically and mechanically connected to one of the support frames 20, 22 and are tilted relative thereto so that the sprung lamellae 18 project into a space radially inside and radially outside the support frames 20, 22 or the sprung lamellar cage.

The contact element 16 is arranged in the external current conducting element 14 such that the sprung lamellae 18 establish electrical contact with the external current conducting element 14 at the radially outer periphery of the contact element 16.

The sprung lamellar cage 16 with the sprung lamellae 18 and the support frame 20, 22 is configured rectangular in cross-section.

In order to establish an electrical contact, a similarly rectangular-shaped internal current conducting element (not shown) can be plugged into the housing 10, 12 and into the contact element 16 such that the sprung lamellae 18 make an electrical contact with the internal current conducting element at an internal periphery of the contact element 16. The contact element 16 is thus arranged between the internal current conducting element and the external current conducting element 14 and transmits electric current therebetween. As a result of the mechanical contact between the sprung lamellae 18 and the current conducting elements 14, the sprung lamellae 18 become twisted about the longitudinal axes thereof so that torsion of the sprung lamellae 18 results, which presses the sprung lamellae against the current conducting elements 14 with a corresponding elastic spring force, so that a corresponding contact surface and a corresponding contact pressure are made available for the electrical contact.

Lugs 24 are arranged at the respective axial ends of the support frames 20, 22 facing away from the sprung lamellae 18. The lugs serve for axially fixing the contact element 16 within the housing 10, 12. For this purpose, corresponding elevations 26 which provide stops are formed by the assembled housing halves 10, 12. As a result, no undercuts are needed at the external current conducting element 14, but rather the axial fixing of the contact element 16 is automatically provided by the assembly of the housing halves 10, 12. For this purpose, the housing halves 10, 12 are configured so as to extend beyond the exterior current conducting element 14 in the axial direction at the axial end where the interior current conducting element can be plugged into the housing 10, 12 or the contact element 16 or the exterior current conducting element 14 (the plug-side end). The housing halves 10, 12 also project radially inwardly in the region where said housing halves extend axially beyond the exterior current conducting element 14 and thereby form elevations 26 which provide axial stops for the lugs 24. At the same time, the stops of the elevations 26 also fix the exterior current conducting element 14 in the axial direction within the housing 10, 12.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A high current connector for transmitting electric currents, comprising at least one contact element establishing an electrical contact between an internal current conducting element and an external current conducting element, said contact element having a plurality of spring elements establishing an electrical multi-point contact between the internal current conducting element and the external current conducting element, the contact element including, at each axial end thereof, a support frame, said spring elements being mechanically and electrically connected at the axial ends thereof to said support frames, the spring elements being tilted relative to the support frames so that they project into a space radially inside and radially outside the support frames, said contact element arranged in a housing together with said external current conducting element such that said spring elements establish an electrical contact with the external current conducting element at a radial outer side of the contact element, and that an internal current conducting element can be inserted into the housing at a plug-side end of the high current connector in such a manner that the spring elements establish contact with the internal current conducting element at a radial inner side of the contact element, said housing extending, at the plug-side end of the high current connector, beyond the external current conducting element in the axial direction, over a predetermined section and, said housing including, in the region of said predetermined section, a radially inwardly projecting housing section such that said contact element is fixed by resting against said projecting housing section in the axial direction inside said housing.

2. The high current connector of claim 1, wherein the contact element is rectangular in cross-section.

3. The high current connector of claim 1, wherein said spring elements are lamellar.

4. The high current connector of claim 3 including at least one lug arranged at one axial end of at least one of said support frames facing away from said spring elements.

5. The high current connector of claim 1 including at least one lug arranged at one axial end of at least one of said support frames facing away from said spring elements.

* * * * *